US006223937B1

(12) United States Patent
Schmidt

(10) Patent No.: US 6,223,937 B1
(45) Date of Patent: May 1, 2001

(54) PORTABLE DISPENSING BOTTLE WITH DISSOLVABLE WAX PLUG AT INLET

(76) Inventor: Kevin Schmidt, 511 Wyckoff Ave., Wyckoff, NJ (US) 07481

( * ) Notice: Subject to any disclaimer, the term of this patent is extended or adjusted under 35 U.S.C. 154(b) by 0 days.

(21) Appl. No.: 09/441,869

(22) Filed: Nov. 17, 1999

(51) Int. Cl.[7] ..... B65D 41/00
(52) U.S. Cl. ..... 222/54; 215/363; 215/364
(58) Field of Search ..... 222/54; 215/355, 215/363, 364

(56) References Cited

U.S. PATENT DOCUMENTS

| | | | | |
|---|---|---|---|---|
| 1,724,919 | | 8/1929 | Fenske . | |
| 1,815,418 | | 7/1931 | O'Bryan . | |
| 3,958,944 | | 5/1976 | Wong . | |
| 4,022,148 | * | 5/1977 | Chapman | 116/106 |
| 4,087,019 | | 5/1978 | Yamazaki . | |
| 4,105,040 | | 8/1978 | Chester . | |
| 4,402,516 | | 9/1983 | Gans et al. . | |
| 4,407,432 | * | 10/1983 | Shichman | 222/54 |
| 4,456,140 | | 6/1984 | Geiger . | |
| 4,484,750 | | 11/1984 | Scruggs . | |
| 4,638,134 | | 1/1987 | Stritzke . | |
| 4,700,857 | * | 10/1987 | Kittscher et al. | 215/232 |
| 5,320,178 | | 6/1994 | Cornette . | |
| 5,390,723 | | 2/1995 | Mohla et al. . | |
| 5,423,966 | | 6/1995 | Wiktorowicz . | |
| 5,431,303 | * | 7/1995 | Miskell | 222/54 |
| 5,516,042 | | 5/1996 | Gerstengerger . | |
| 5,718,415 | | 2/1998 | Dainton . | |
| 5,803,285 | | 9/1998 | Hirota . | |
| 5,855,287 | | 1/1999 | Burns . | |

* cited by examiner

*Primary Examiner*—J. Casimer Jacyna
(74) *Attorney, Agent, or Firm*—Richard M. Goldberg

(57) ABSTRACT

A dispensing bottle includes a hollow main body; a neck having an opening in open communication with an interior of the main body and an inner facing surface provided with a lip; a red paraffin wax plug made of a wax material that melts at a predetermined temperature and has an outwardly facing peripheral surface with a groove; a retaining plug within the neck for holding the wax plug within the neck of the bottle, the retaining plug formed by an annular member having an outer facing peripheral surface formed with a groove for mating with the lip in the neck, and an inner facing peripheral surface defining a center opening in which the wax plug is held and having an inwardly extending lip that engages within the groove in the wax plug; and a removable closure cap in covering relation to the opening.

8 Claims, 3 Drawing Sheets

PORTABLE DISPENSING BOTTLE WITH DISSOLVABLE WAX PLUG AT INLET

BACKGROUND OF THE INVENTION

The present invention relates generally to bottles, and more particularly, to a bottle having a wax plug in the neck thereof which dissolves in the presence of heat in order to dispense the contents in the bottle.

Dishwashers have a tendency to accumulate calcium, lime, scale, etc. over time on the walls thereof, particularly in areas having hard water. In many dishwashers, there is a short duration pump cycle, for example, for fifteen seconds, in which all liquid contents in the dishwasher are pumped out, prior to starting the cleaning operation. Therefore, any cleaning liquid placed in the dishwasher at the start of operation is merely pumped out and does not clean the walls of the dishwasher.

Although compartments are provided for a viscous dishwashing liquid or a dishwashing powder, these compartments are not suitable for holding a non-viscous cleaning liquid for cleaning calcium, lime, scale, etc. from the dishwasher walls.

Therefore, there is a need for forming a way to dispense the non-viscous liquid into the dishwasher during the wash cycle, without opening the dishwasher at this time and pouring the cleaning liquid into the dishwasher.

SUMMARY OF THE INVENTION

Accordingly, it is an object of the present invention to provide a portable dispensing bottle with a dissolvable wax plug at the inlet that overcomes the aforementioned problems.

It is another object of the present invention to provide a portable dispensing bottle with a dissolvable wax plug in which the wax plug dissolves during the wash cycle in the presence of heated water.

It is still another object of the present invention to provide a portable dispensing bottle with a dissolvable wax plug that is easy and economical to manufacture and use.

In accordance with an aspect of the present invention, a dispensing bottle including a hollow main body; a neck having an opening in open communication with an interior of the main body; a wax plug in the neck, the wax plug made of a wax material that melts at a predetermined temperature; and a removable closure cap in covering relation to the opening. Further, the neck has an inner surface with one of a lip and a groove for capturing the wax plug to prevent the wax plug from falling into the main body.

In accordance with another aspect of the present invention, a dispensing bottle includes a hollow main body having an opening; a wax plug made of a wax material that melts at a predetermined temperature; and a retaining plug positioned in the opening for holding the wax plug in the opening of the bottle.

The hollow main body includes a neck having the opening in open communication with an interior of the main body; and the retaining plug is positioned in the neck for holding the wax plug in the neck of the bottle. A removable closure cap is in covering relation to the opening.

The retaining plug comprises an annular member including an outer facing peripheral surface, and an inner facing peripheral surface defining a center opening in which the wax plug is held.

In one embodiment, an inner facing surface of the opening is provided with one of a lip and a groove, and the outer facing peripheral surface of the retaining plug is formed with the other of the lip and the groove for mating with the one of the lip and the groove in the opening.

In another embodiment, an inner facing surface of the opening is provided with one of a groove and lip, and the outer facing peripheral surface of the retaining plug is formed with upper and lower tapered portions that form a substantially V-shape in cross section, and a meeting portion of the upper and lower tapered portions mates with the one of the groove and lip in the opening, to hold the retaining plug in the opening.

Also, the inner facing peripheral surface includes one of an inwardly extending lip and a groove, and the wax plug includes an outwardly facing peripheral surface with the other of the inwardly extending lip and a groove that fits within the one of the inwardly extending lip and groove.

The retaining plug includes an outwardly extending flange which rests on an upper edge of the bottle in surrounding relation to the opening when the retaining plug is positioned in the opening.

The wax plug is made from a paraffin wax, and preferably, a red paraffin wax having a melting temperature of about 125° F.

In accordance with still another aspect of the present invention, a dispensing bottle includes a hollow main body; a neck having an opening in open communication with an interior of the main body; a wax plug in the neck, the wax plug made of a wax material that melts at a predetermined temperature; and an arrangement for capturing the wax plug in the neck.

The arrangement includes a retaining plug positioned in the opening for holding the wax plug in the neck of the bottle. There is also a removable closure cap in covering relation to the opening in the neck.

The above and other objects, features and advantages of the present invention will become readily apparent from the following detailed description thereof which is to be read in connection with the accompanying drawings.

DETAILED DESCRIPTION

Figure 1:
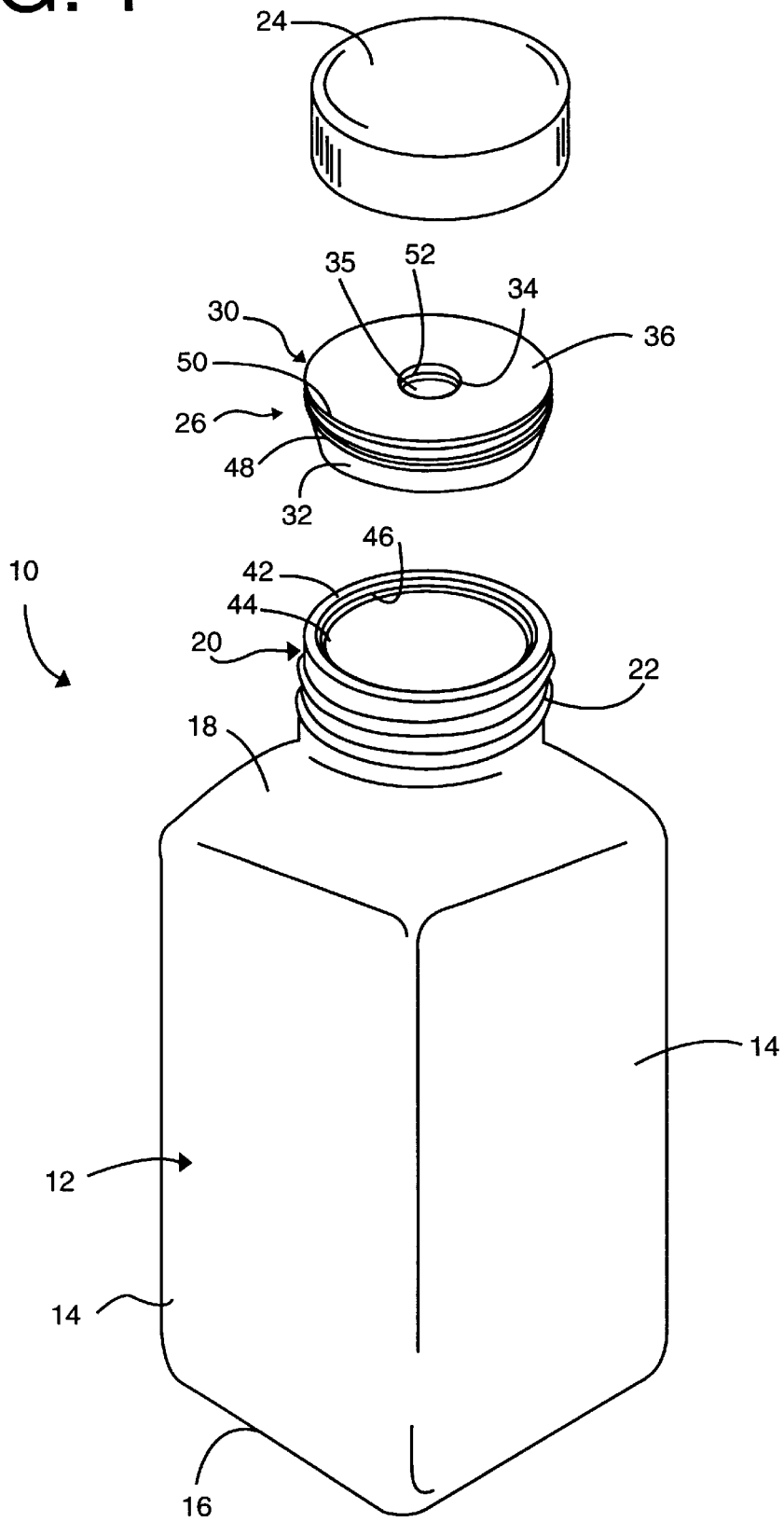
FIG. 1 is a perspective exploded view of a portable dispensing bottle according to the present invention, with the wax plug removed.
Figure 2:
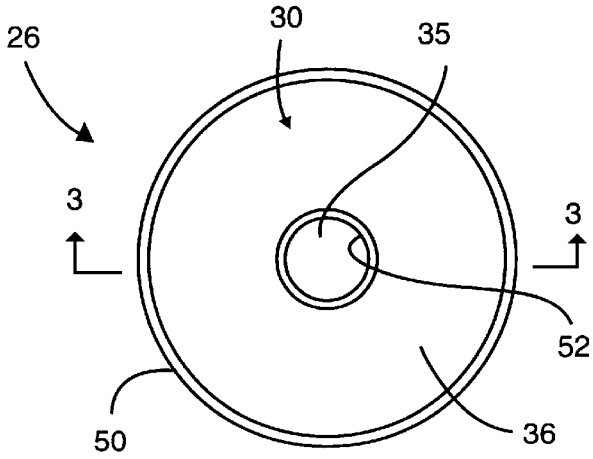
FIG. 2 is a top plan view of the retainer ring.
Figure 3:
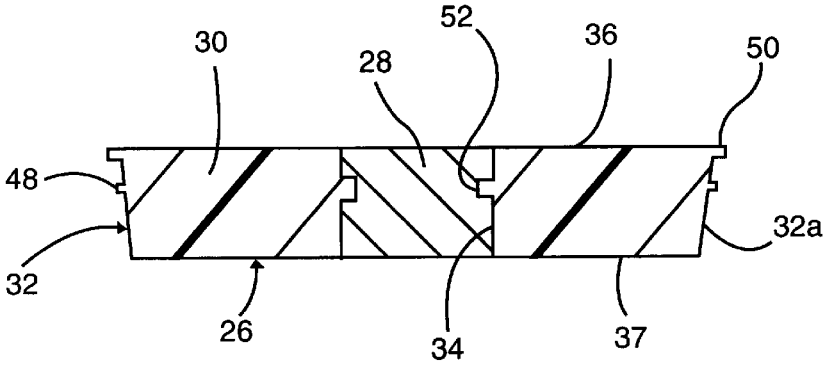
FIG. 3 is a cross-sectional view of the retainer ring, with the wax plug therein, taken along line 3—3 thereof.

Referring to the drawings in detail, a portable dispensing bottle 10 according to the present invention includes a hollow main body 12 having at least one side wall 14, a closed bottom wall 16 and a top wall 18 that leads into a reduced diameter annular neck 20 that is in open communication with the interior of main body 12. As is conventional, neck 20 has external threads 22 for threadedly receiving a closure cap 24 having mating internal threads (not shown).

In accordance with the present invention, a retaining plug 26 is held within neck 20 for holding a dissolvable wax plug 28. Thus, retaining plug 26 will have a height and diameter in dependence upon the size of neck 20. An appropriate height can be, for example, 0.2 to 0.4 inch and an appropriate outside diameter can be, for example, 1.0 to 1.5 inches.

Specifically, retaining plug 26 is formed by an annular member 30 that forms a liquid tight seal with neck 20 and has an outer facing peripheral surface 32, an inner facing peripheral surface 34 defining a center opening 35, a planar upper surface 36 and a planar lower surface 37. An arrangement is provided to releasably capture retaining plug 26 in neck 20. In this regard, as shown in FIG. 1, the inner surface of neck 20 includes a first inwardly directed annular lip 42 at the upper edge thereof, and a second inwardly directed annular lip 44 spaced below lip 42, so as to define an annular groove 46 therebetween. The outer facing peripheral surface 32 of retaining ring 26 is formed with an outwardly extending annular lip 48 spaced slightly below upper surface 36 thereof. Thus, when retaining ring 26 is inserted into annular neck 20, and because of the material of retaining plug 26, some deformation takes place to permit annular lip 48 to fit and be captured within groove 46. In order to aid in this fit, outer facing peripheral surface 32 is preferably tapered inwardly at a lower portion 32*a* thereof, below annular lip 48.

In addition, to prevent retaining plug 26 from accidentally falling into main body 12, an outwardly extending flange 50 is provided coplanar and contiguous with planar upper surface 36. Thus, when annular lip 48 fits within groove 46, outwardly extending flange 50 seats upon the upper edge of neck 20.

It will be appreciated that retaining plug 26 can be made from various materials, such as plastic, rubber, etc. Further, although the aforementioned capture arrangement for retaining plug 26 is preferred, retaining plug 26 can merely form a friction fit within the inner surface of neck 20. In such case, first inwardly directed annular lip 42, second inwardly directed annular lip 44, annular groove 46, and outwardly extending annular lip 48 would be eliminated.

Figure 4:
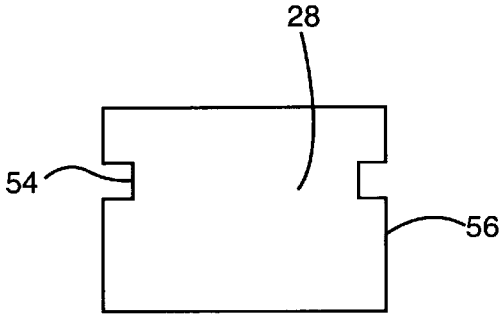
FIG. 4 is a side elevational view of the wax plug.

In order to prevent wax plug 28 from falling into main body 12, it is preferable that another capture arrangement be provided in retaining plug 26. For example, inner facing peripheral surface 34 can include an inwardly extending annular lip 52. In a forming operation, melted wax is poured into center opening 35 of retaining plug 26 and permitted to harden. As a result, as shown in FIG. 4, wax plug 28 is formed as a cylindrical member with an annular groove 54 on the outer facing peripheral surface 56 thereof which is formed by and which receives inwardly extending annular lip 52. As a result, wax plug 28 is captured within retaining plug 26 in a liquid tight sealing manner. Alternatively, inner facing peripheral surface 34 can include an annular groove, in which case, when wax plug 28 is formed, it will include an outwardly extending annular lip that fits within the annular groove.

With the arrangement discussed above, main body 12 is filled with a liquid for cleaning scale, lime, calcium, etc. Then, with wax plug 28 hardened into retaining plug 26, retaining plug 26 is snap fit within neck 20 such that outwardly extending annular lip 48 snap fits within annular groove 46, and outwardly extending flange 50 seats on the upper edge of neck 20. Then, closure cap 24 is threadedly engaged on neck 20. Suitable sealing arrangements, such as plastic wrap, break away seals or the like (not shown), which are conventional, can be provided to prevent inadvertent removal of closure cap 24 from neck 20.

In use, closure cap 24 is removed, and bottle 10 is positioned in a dishwasher rack in an inverted orientation, that is, with neck 20 facing down. Because of retaining ring 26 and wax plug 28, a seal is provided in neck 20 to prevent the liquid contents from escaping. A normal dishwasher cycle includes a four minute pre-wash, followed by a four minute rinse with heated water in the temperature range of about 110° F.–120° F. Thereafter, a fifteen minute wash cycle is provided with the water heated further in the temperature range of about 125° F.–145° F. This is followed by a fifteen minute rinse cycle, and then a drying cycle.

In accordance with the present invention, wax plug 28 is made from a wax material that melts or dissolves in the wash cycle. A suitable amount of wax material can be 0.5 gram. Wax plug materials can include bees' wax and synthetic bees' wax, carnauba wax, partial glycerides, polyethylene glycol (PEG), polyglycolized glycerides, fatty acids and/or esters thereof, glyceryl stearate, palmitosterate, paraffin wax, white wax, higher fats, and polymeric materials such as polyurethane, ethylmethacrylate (EMA), hydroxyethylmethacrylate (HEMA), or any other suitable material. Preferably, a red paraffin wax is used, which has a melting point of 125° F. In such case, about two minutes into the wash cycle, wax plug 28 will melt, whereby the cleaning liquid in main body 12 will flow out of neck 20 into the dishwasher in order to remove the calcium, lime, scale, etc. from the walls of the dishwasher. of course, it will be appreciated that this occurs without any dishes, glassware or flatware in the dishwasher, since the cleaning liquid could cause damage thereto.

Figure 5:
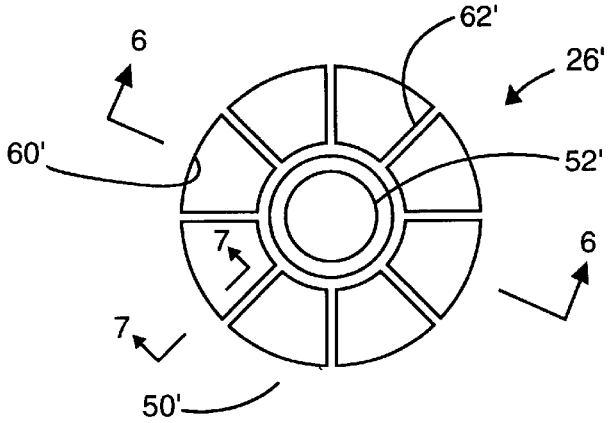
FIG. 5 is a top plan view of a retainer ring according to another embodiment of the present invention.
Figure 6:
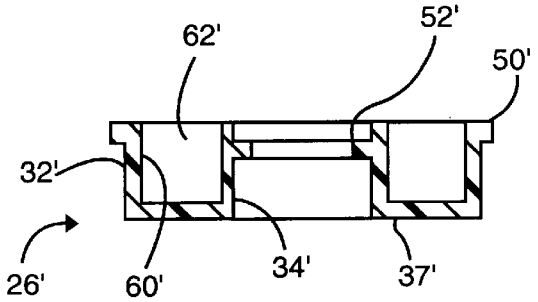
FIG. 6 is a cross-sectional view of the retainer ring of FIG. 5, taken along line 6—6 of FIG. 5.
Figure 7:
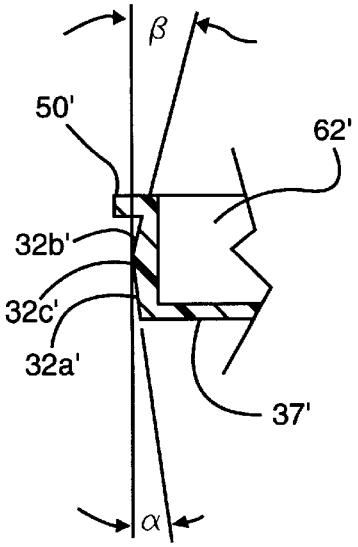
FIG. 7 is an enlarged cross-sectional view of a portion of the retainer ring of FIG. 5, taken along line 7—7 of FIG. 5.

Referring now to FIGS. 5–7, a retaining plug 26' according to another embodiment of the invention is shown in which like parts are designated by like numerals, but with a prime (') added thereto, and a detailed description of the common parts will not be discussed in detail for the sake of brevity.

Retaining plug 26' differs from retaining plug 26 by a plurality of, for example, eight, sector shaped recesses 60' in the top thereof, separated by radially oriented dividing walls 62' which extend between outer facing peripheral surface 32' and inner facing peripheral surface 34'. This reduces the amount of material of retaining plug 26', while maintaining the necessary structural rigidity thereof.

In addition, rather than providing a separate outwardly extending annular lip 48, the upper portion 32*b'* of outer facing peripheral surface 32', which extends upwardly from tapered lower portion 32*a'*, is also tapered inwardly. Thus, outer facing peripheral surface 32' has a V-shaped cross-sectional configuration. As examples, the taper of lower portion 32*a'* can be equal to an angle $\alpha$ of approximately 8.1° to a vertical, and the taper of upper portion 32*b' can be equal to an angle* $\beta$ *of approximately* 14.3° to a vertical. Accordingly, the annular portion 32*c'*, where lower and upper portions 32*a'* and 32*b'* meet, is snap fit within annular groove 46 in neck 20 to hold retaining plug 26' in annular neck 20. Alternatively, the V-shape of outer facing peripheral surface 32' can be inwardly in the opposite direction, and the inner surface of neck 20 can be provided with a lip that fits therein in place of groove 46.

As a still further alternative embodiment, retaining plug 26 can be eliminated, and instead, the wax plug can be formed directly in neck 20. In such case, annular groove 46 would prevent the wax plug from falling into main body 12. Then, after the wax plug is hardened, closure cap 24 would be threaded onto neck 20. In such case, the bottle would be filled through another portion. For example, the bottom could be open for filling purposes, and then bottom wall 16 would be inserted over the bottom opening and welded with side wall 14.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A despensing bottle comprising:

a hollow main body having a neck with an opening in open communication with an interior of said main body;

a retaining plug held in said opening in said neck and engaging said neck, said retaining plug having a bore extending therethrouqh;

a wax plug made of a wax material that melts at a predetermined temperature, said wax plug held in said bore in said retaining plug; and a closure cap removably engaged on said neck in covering relation to the opening and said bore, said closure cap being separate from said retaining plug.

2. A dispensing bottle according to claim 1, wherein said retaining plug comprises an annular member including:

an outer facing peripheral surface, and an inner facing peripheral surface defining said bore in which said wax plug is held.

3. A dispensing bottle according to claim 2, wherein said inner facing peripheral surface includes one of an inwardly extending lip and a groove, and the wax plug includes an outwardly facing peripheral surface with the other of the inwardly extending lip and a groove that fits within said one of the inwardly extending lip and groove.

4. A dispensing bottle according to claim 1, wherein said retaining plug includes an outwardly extending flange which rests on an upper edge of said bottle in surrounding relation to said opening when said retaining plug is positioned in said opening.

5. A dispensing bottle according to claim 1, wherein said wax plug is made from a paraffin wax.

6. A dispensing bottle according to claim 5, wherein said wax plug is ma de from a red paraffin wax having a melting temperature of about 125° F.

7. A dispensing bottle comprising:

a hollow main body having an opening, an inner facing surface of said opening being provided with one of a lip and a groove;

a wax plug made of a wax material that melts at a predetermined temperature; and a retaining plug positioned in said opening for holding said wax plug in said opening of said bottle, said retaining plug comprising an annular member including:

an outer facing peripheral surface formed with the other of the lip and the groove for mating with said one of the lip and the groove in said opening, and an inner facing peripheral surface defining a center opening in which said wax plug is held.

8. A dispensing bottle comprising:

a hollow main body having an opening, an inner facing surface of said opening being provided with one of a groove and lip;

a wax plug made of a wax material that melts at a predetermined temperature; and a retaining plug positioned in said opening for holding said wax plug in said opening of said bottle, said retaining plug comprising an annular member including:

an outer facing peripheral surface formed with upper and lower tapered portions that form a substantially V-shape in cross section, and a meeting portion of the upper and lower tapered portions mates with the one of the groove and lip in said opening, to hold said retaining plug in said opening, and an inner facing peripheral surface defining a center opening in which said wax plug is held.

* * * * *